US007182700B2

(12) United States Patent
Endo et al.

(10) Patent No.: US 7,182,700 B2
(45) Date of Patent: Feb. 27, 2007

(54) GOLF BALL

(75) Inventors: Seiichiro Endo, Kobe (JP); Keiji Ohama, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/353,930

(22) Filed: Jan. 30, 2003

(65) Prior Publication Data

US 2003/0153406 A1 Aug. 14, 2003

(30) Foreign Application Priority Data

Feb. 13, 2002 (JP) ..... 2002-034979

(51) Int. Cl.
*A63B 37/06* (2006.01)

(52) U.S. Cl. ..... 473/374; 473/370

(58) Field of Classification Search ..... 473/351–377
See application file for complete search history.

(56) References Cited

U.S. PATENT DOCUMENTS

| | | | | |
|---|---|---|---|---|
| 5,050,886 | A * | 9/1991 | Yamagishi et al. | 473/372 |
| 5,407,998 | A * | 4/1995 | Horiuchi et al. | 525/133 |
| 5,721,304 | A * | 2/1998 | Pasqua, Jr. | 524/433 |
| 5,779,562 | A | 7/1998 | Melvin et al. | |
| 5,961,401 | A * | 10/1999 | Masutani et al. | 473/374 |
| 5,967,907 | A * | 10/1999 | Takemura et al. | 473/373 |
| 6,114,453 | A * | 9/2000 | Irii et al. | 525/221 |
| 6,361,453 | B1 | 3/2002 | Nakamura et al. | |
| 6,899,642 | B2 * | 5/2005 | Morgan et al. | 473/374 |
| 2003/0080469 | A1 * | 5/2003 | Endo et al. | 264/320 |
| 2003/0148826 | A1 * | 8/2003 | Ohama et al. | 473/371 |

FOREIGN PATENT DOCUMENTS

| | | | |
|---|---|---|---|
| JP | 06-091019 | A | 4/1994 |
| JP | 07-185039 | A | 7/1995 |
| JP | 61-94666 | A | 5/1996 |
| JP | 10127820 | A * | 5/1998 |
| JP | 10179804 | A * | 7/1998 |
| JP | 2000-051402 | A | 2/2000 |
| JP | 2001-029511 | A | 2/2001 |

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

Golf ball 1 has a core 2, a mid layer 3 and a cover 4. The mid layer 3 comprises a matrix of which base material is a rubber or a synthetic resin, and solid particles which are dispersed in this matrix. Hardness Hg of the solid particles is greater than hardness Hm of the matrix. Difference between both hardness (Hg–Hm) is greater than 5. Particle size D of the solid particles is 0.5 mm or greater. A ratio "D/T", i.e., a ratio of the particle size D of the solid particles to the thickness T of the mid layer is equal to or greater than 0.1. A proportion of the solid particles occupied in the mid layer 3 is 5% by weight or greater and 50% by weight or less. Hardness Hg of the solid particles is equal to or greater than 40. Hardness Hm of the matrix is equal to or greater than 30.

13 Claims, 2 Drawing Sheets

3

GOLF BALL

This nonprovisional application claims priority under 35 U.S.C. § 119(a) on Patent Application No. 2002-034979 filed in JAPAN on Feb. 13, 2002, which is herein incorporated by reference.

BACKGROUND OF THE INVENTION

1. Field of the Invention

The present invention relates to golf balls. More particularly, the present invention relates to solid golf balls having a core, a mid layer and a cover.

2. Description of the Related Art

Golf balls used for playing golf at a golf course are generally classified into: wound golf balls having a core comprising wound rubber threads; and solid golf balls having a core comprising a solid rubber. Wound golf balls have been conventionally used, with a period during which the wound golf balls account for almost all of the first-class golf balls. However, solid golf balls that have been developed afterwards can be readily manufactured at a lower cost, therefore, larger number of solid golf balls have been recently supplied to the market than the wound golf balls. In general, solid golf balls have drawbacks in a feel at impact being hard compared to wound golf balls. To the contrary, common solid golf balls are more excellent in terms of a travel distance than wound golf balls. In an attempt to improve a feel at impact and to further enhance a flight performance, solid golf balls having a mid layer between a core and a cover have been proposed and placed on the market.

Meanwhile, a variety of techniques have been proposed where particles (solids) comprising a crosslinked rubber or a synthetic resin are blended in a core of a solid golf ball. For example, a core blended with particles of ebonite that is a highly hard rubber is disclosed in Japanese Patent Publication Reference JP-A-94666/1986. In Japanese Patent Publication Reference JP-A-91019/1994, there is disclosed a core blended with high molecular weight polyethylene (trade name: "Miperon XM220") having Shore D hardness of about 65. In Japanese Patent Publication Reference JP-A-185039/1995, there is disclosed a golf ball with mitigated impulsive force at impact through blending vulcanized rubber powder having a particle diameter of from 0.8 mm to 7.0 mm in a core. In Japanese Patent Publication Reference JP-A-314342/1998, there is disclosed a golf ball having a central core layer, an outer core layer, an inner cover layer (This inner cover layer can be also assumed as an outermost layer of the core.) and an outer cover layer, wherein polypropylene powder is blended in the core.

In Japanese Patent Publication Reference JP-A-583/2001, there is disclosed a golf ball having a core blended with particles of which hardness being higher than the hardness of the core surface. In Japanese Patent Publication Reference JP-A-584/2001, there is disclosed a golf ball having a core blended with particles of which difference from the core being small in their specific gravity. In Japanese Patent Publication Reference JP-A-587/2001, there is disclosed a golf ball having a core blended with particles, without exposure of these particles to the core surface. Japanese Patent Publication Reference JP-A-29511/2001 discloses a golf ball having a mid layer including rubber particles dispersed in a thermoplastic resin.

Even with these golf balls including particles blended therein, concomitant achievement of favorable flight performance and soft feel at impact has not been enabled. The present invention was made taking into account of such circumstances, and an object of the present invention is to provide golf balls which are excellent in both respects of the flight performance and feel at impact.

SUMMARY OF THE INVENTION

A golf ball according to the present invention has a core, a mid layer and a cover. This mid layer comprises a matrix of which base material is a rubber or a synthetic resin, and solid particles which are dispersed in this matrix and have a particle size D of greater than or equal to 0.5 mm. When it is assumed that Shore D hardness of the solid particles be Hg and that Shore D hardness of this matrix be Hm, difference between both hardness (Hg−Hm), is greater than 5.

The mid layer of this golf ball comprises solid particles having relatively high hardness and large diameter. This solid particle elevates the travel distance of the golf ball by improving the resilience performance and optimizing the trajectory resulting from lowered spin. The matrix of this mid layer has relatively low hardness. This matrix contributes to the improvement of the feel at impact of the golf ball.

Preferably, Shore D hardness Hg of the solid particles is equal to or greater than 40. Such a solid particle more greatly contributes to the improvement of the flight performance of the golf ball.

A ratio "D/T", i.e., a ratio of the particle size D of the solid particles to the thickness T of the mid layer is preferably equal to or greater than 0.1. Blending such solid particles results in further improvement of the flight performance of the golf ball.

A proportion of the solid particles occupied in the mid layer is preferably 5% by weight or greater and 50% by weight or less. In accordance with the golf ball having this mid layer, an extremely superior feel at impact and a long travel distance can be achieved.

In light of the flight performance, it is preferred that Shore D hardness Hm of the matrix be equal to or greater than 30.

DESCRIPTION OF THE PREFERRED EMBODIMENTS

The present invention is hereinafter described in detail with appropriate references to the accompanying drawing according to the preferred embodiments of the present invention.

Figure 1:
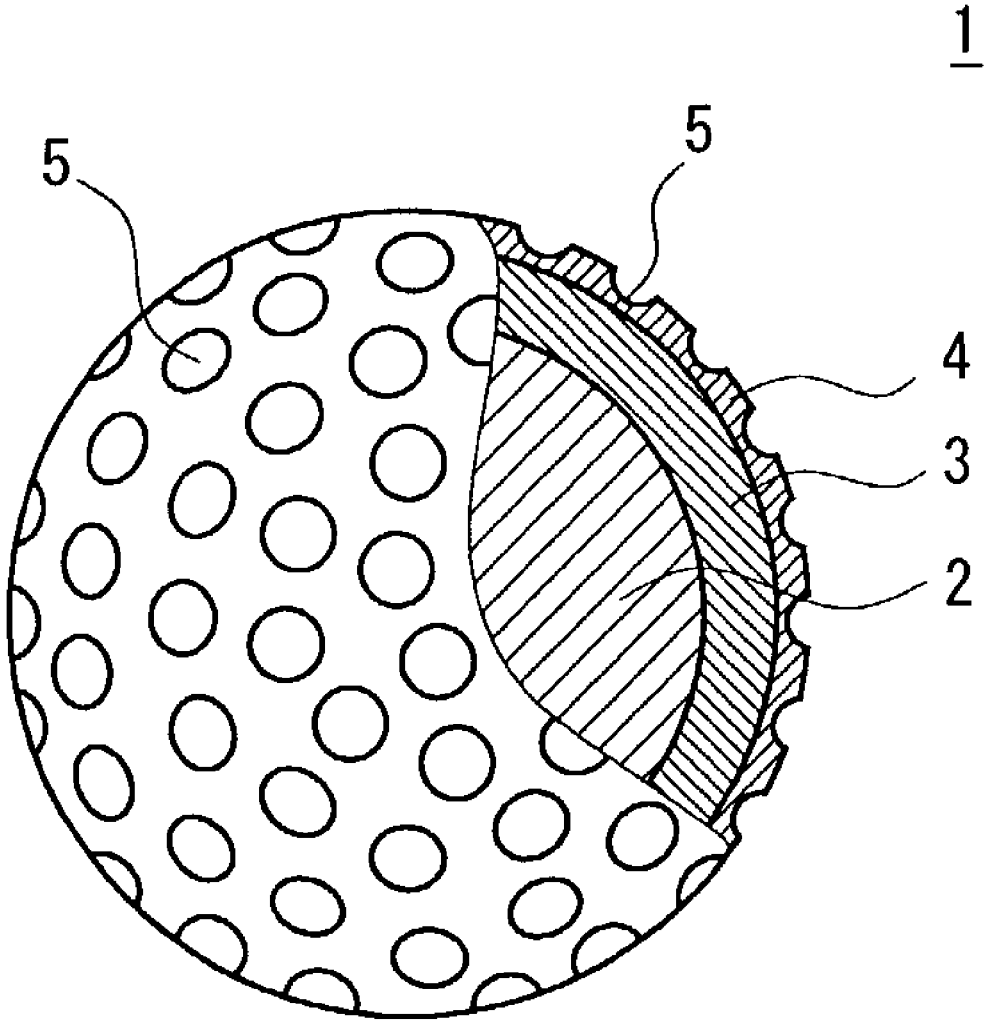
FIG. 1 is a cross-sectional view with a partially cut off part illustrating a golf ball according to one embodiment of the present invention.

A golf ball 1 depicted in FIG. 1 has a core 2, a mid layer 3 and a cover 4. Numerous dimples 5 are formed on the surface of the cover 4. This golf ball 1 has a paint layer and a mark layer to the external side of the cover 4, although not shown in the Figure. This golf ball 1 has a diameter of from 40 mm to 45 mm, and in particular, of from 42 mm to 44 mm. In light of the reduction of air resistance in the range to comply with a rule defined by United States Golf Association (USGA), the diameter is preferably 42.67 mm or greater and 42.80 mm or less. Weight of this golf ball 1 is 40 g or greater and 50 g or less, and particularly 44 g or greater and 47 g or less. In light of the elevation of inertia in the range to comply with a rule defined by United States Golf Association, the golf ball 1 preferably has weight of 45.00 g or greater and 45.93 g or less.

Figure 2:
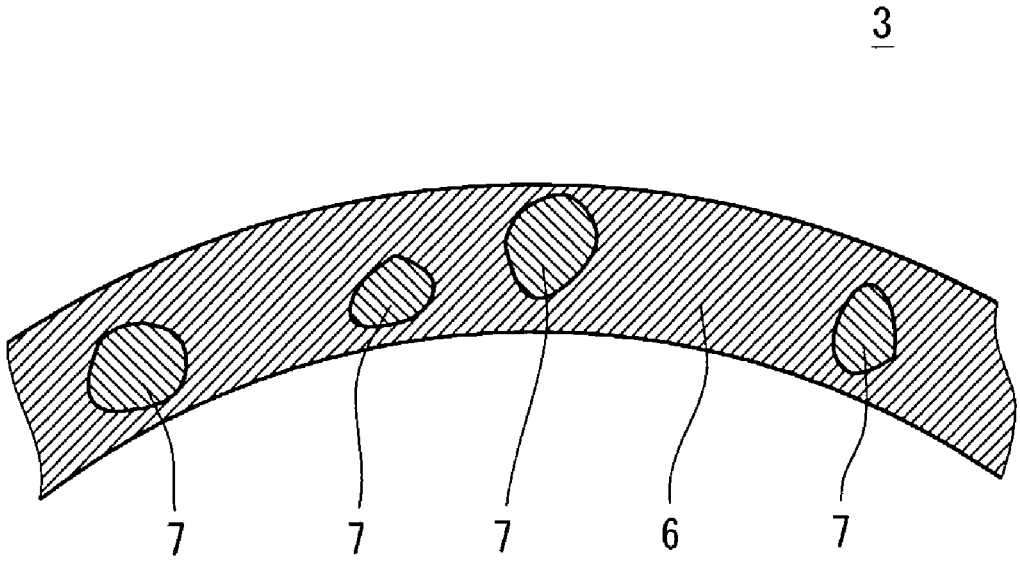
FIG. 2 is an enlarged cross-sectional view illustrating a part of a mid layer of the golf bell shown in FIG. 1.

FIG. 2 is an enlarged cross-sectional view illustrating a part of the mid layer 3 of the golf ball 1 shown in FIG. 1. The mid layer 3 is composed of a matrix 6 of which base material is a rubber or a synthetic resin, and solid particles 7 dispersed in this matrix 6. Hardness Hg of the solid particles 7 is greater than hardness Hm of the matrix 6. Difference between both hardness (Hg−Hm) is greater then 5. In other words, the mid layer 3 is composed of a matrix 6 having relatively low hardness and solid particles 7 having relatively high hardness. Hardness is measured in accordance with a standard of "ASTM-D 2240-68", with Shore D type spring hardness scale. When the sample to be measured consists of a resin composition, hardness is measured with a slab molded from this resin composition. When the sample to be measured consists of a rubber composition to be crosslinked, hardness is measured with a slab prepared by crosslinking the rubber composition under the identical condition of a subject crosslinking condition.

By employing the solid particles 7 having high hardness, a resilience performance of the golf ball 1 is improved. In addition, spin speed of the golf ball 1 is decreased by employing the solid particles 7 having high hardness, thereby optimizing a trajectory. On behalf of the excellent resilience performance and optimized trajectory, the travel distance of the golf ball 1 is increased.

In light of the flight performance, hardness Hg of the solid particles 7 is preferably 40 or greater, more preferably 42 or greater, and particularly preferably 45 or greater. When hardness Hg of the solid particles 7 is too high, the feel at impact becomes hard even though the matrix 6 having low hardness is used. Thus, hardness Hg is preferably 75 or less, more preferably 70 or less, and particularly preferably 65 or less.

By blending the solid particles 7 having high hardness, a flight performance of the golf ball 1 is maintained even though the matrix 6 having low hardness is used. In other words, employing a matrix 6 having low hardness is enabled by blending the solid particles 7 having high hardness. The matrix 6 having low hardness contributes to the improvement of the feel at impact. In accordance with this golf ball 1, an excellent flight performance and a soft feel at impact are both accomplished concurrently.

In light of the feel at impact, hardness Hm of the matrix 6 is preferably 70 or less, more preferably 68 or less, and particularly preferably 65 or less. When hardness Hm of the matrix 6 is too low, the improvement of the flight performance of the golf ball 1 becomes difficult even though solid particles 7 having high hardness are blended. In this respect, hardness of Hm of the matrix 6 is preferably 30 or greater, more preferably 32 or greater, and particularly preferably 35 or greater.

Difference between hardness Hg of the solid particles 7 and hardness Hm of the matrix 6, i.e., (Hg−Hm) is greater than 5 as described herein above. Accordingly, an excellent flight performance and a soft feel at impact are both accomplished concurrently. In this respect, the difference of hardness (Hg−Hm) is more preferably 7 or greater, and particularly preferably 10 or greater. When the difference of hardness (Hg−Hm) is too large, deteriorated flight performance resulting from the matrix 6 may be significant, or alternatively, deteriorated feel at impact resulting from the solid particles 7 may be significant. Therefore, the difference of hardness (Hg−Hm) is preferably 50 or less, and particularly preferably 35 or less.

The mid layer 3 comprises solid particles 7 having a particle size D of 0.5 mm or greater, i.e., solid particles 7 having a large diameter. The solid particles 7 having a large diameter improve the flight performance of the golf ball 1. In this respect, solid particles 7 having a particle size D of 0.7 mm or greater are more preferable, and solid particles 7 having a particle size D of 0.9 mm or greater are particularly preferable. Upper limit of the particle size D is determined on the basis of the relation with the thickness T of the mid layer 3 described herein after. Solid particles 7 having a particle size D of 0.5 mm or greater and solid particles 7 having a particle size D of less than 0.5 mm maybe mixed together. The particle size D is measured in conformity with the regulation of "JIS K 6316" using a sieve specified in "JIS Z 8801".

It is preferred that the mid layer 3 comprises solid particles 7 having a ratio "D/T", i.e., a ratio of the particle size D to the thickness T of the mid layer 3, being 0.1 or greater. This solid particle 7 improves the flight performance of the golf ball 1. In this respect, solid particles 7 having a ratio "D/T" of 0.2 or greater are more preferred, and solid particles 7 having a ratio "D/T" of 0.3 or greater are particularly preferred. When the ratio "D/T" is too large, the solid particles 7 are exposed out of the inner side surface or outer side surface of the mid layer 3. Therefore, solid particles 7 having the ratio "D/T" of 1.1 or less are preferred, and solid particles 7 having the ratio "D/T" of 0.9 or less are particularly preferred. Solid particles 7 having the ratio "D/T" of 0.1 or greater and solid particles 7 having the ratio "D/T" of less than 0.1 may be mixed together. The thickness T of the mid layer 3 is usually 0.3 mm or greater and 7.0 mm or less, and particularly, 0.5 mm or greater and 5.0 mm or less.

It is preferred that a proportion (percentage content) of the solid particles 7 occupied in the mid layer 3 be 5% by weight or greater and 50% by weight or less. When the proportion is less than the above range, the improvement of the flight performance may become insufficient. In this respect, the proportion is more preferably 7% by weight or greater, even more preferably 10% by weight or greater, and particularly preferably 12% by weight or greater. When the proportion is beyond the above range, the feel at impact of the golf ball 1 may become hard. In this respect, the proportion is more preferably 45% by weight or less, even more preferably 40% by weight or less, and particularly preferably 35% by weight or less.

When the solid particles 7 having a particle size D of 0.5 mm or greater and the solid particles 7 having a particle size D of less than 0.5 mm are admixed together, it is preferred that the proportion of the solid particles 7 having a particle size D of 0.5 mm or greater occupied in the mid layer 3 be 5% by weight or greater. When the solid particles 7 having a particle size D of 0.5 mm or greater and the solid particles 7 having a particle size D of less than 0.5 mm are admixed together, it is preferred that the proportion of a total amount of the solid particles 7 occupied in the mid layer 3 be 50% by weight or less.

When the solid particles 7 having a ratio "D/T" of 0.1 or greater and the solid particles 7 having a ratio "D/T" of less than 0.1 are admixed together, it is preferred that the proportion of the solid particles 7 having a ratio "D/T" of 0.1 or greater occupied in the mid layer 3 be 5% by weight or greater. When the solid particles 7 having a ratio "D/T" of 0.1 or greater and the solid particles 7 having a ratio "D/T" of less than 0.1 are admixed together, it is preferred that the proportion of a total amount of the solid particles 7 occupied in the mid layer 3 be 50% by weight or less.

The matrix 6 comprises a rubber or a synthetic resin as a base material. In general, the matrix 6 can be obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In view of the resilience performance, polybutadienes are preferred. Even in the case where another rubber is used in combination with a polybutadiene, to employ a polybutadiene as a predominant component is preferred. More specifically, it is preferred that a proportion of polybutadiene occupied in total base rubber be 50% by weight or greater, and particularly 80% by weight or greater. Among polybutadienes, high cis-polybutadienes are preferred, which have a percentage of cis-1, 4 bond of 40% or greater, and particularly 80% or greater.

Mode of crosslinking in the matrix 6 is not particularly limited. Crosslinking agents which can be used include co-crosslinking agents, organic peroxides, sulfur and the like. For the ground that the resilience performance can be improved, it is preferred that a co-crosslinking agent and an organic peroxide are used in combination. Preferable co-crosslinking agents in view of the resilience performance include monovalent or divalent metal salts of α,β-unsaturated carboxylic acid having 2 to 8 carbon atoms. Specific examples of the preferable co-crosslinking agent include zinc acrylate, magnesium acrylate, zinc methacrylate and magnesium methacrylate. In particular, zinc acrylate is preferred which can result in a high resilience performance.

As a co-crosslinking agent, α,β-unsaturated carboxylic acid having 2 to 8 carbon atoms, and a metal oxide may be blended. Both components react in the rubber composition to give a salt. Preferable α,β-unsaturated carboxylic acids include acrylic acid and methacrylic acid, and in particular, acrylic acid is preferred. Preferable metal oxide includes an oxide of zinc and an oxide of magnesium, and in particular, an oxide of zinc is preferred.

The amount of the co-crosslinking agent to be blended is preferably 10 parts (parts by weight) or greater and 60 parts or less per 100 parts of the base rubber. When the amount to be blended is less than the above range, the resilience performance of the golf ball 1 may become insufficient despite that solid particles 7 having high hardness are blended. In this respect, the amount to be blended is more preferably 15 parts or greater, and particularly preferably 20 parts or greater. When the amount to be blended is beyond the above range, the matrix 6 may be so hard that poor feel at impact may be experienced. In this respect, the amount to be blended is more preferably 50 parts or less, even more preferably 40 parts or less, and particularly preferably 35 parts or less.

In the rubber composition for use in the matrix 6, an organic peroxide may be preferably blended. The organic peroxide serves as a crosslinking agent in conjunction with the above-mentioned metal salt of α,β-unsaturated carboxylic acid, and also serves as a curing agent. By blending the organic peroxide, the resilience performance of the golf ball 1 may be improved. Suitable organic peroxides include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part or greater and 8.0 parts or less per 100 parts of the base rubber. When the amount to be blended is less than the above range, the matrix 6 may be so soft that the resilience performance of the golf ball 1 may become insufficient despite that solid particles 7 having high hardness are blended. In this respect, the amount to be blended is more preferably 0.2 part or greater, even more preferably 0.3 part or greater, and particularly preferably 0.5 part or greater. When the amount to be blended is beyond the above range, the matrix 6 may be so hard that hard feel at impact may be experienced. In this respect, the amount to be blended is more preferably 7.0 parts or less, even more preferably 6.0 parts or less, and particularly preferably 4.0 parts or less.

The matrix 6 may be blended with a filler for the purpose of e.g., adjusting specific gravity. Examples of suitable filler include inorganic salts such as magnesium oxide, zinc oxide, barium sulfate, calcium carbonate and the like; and powder of highly dense metal such as tungsten, molybdenum and the like. The amount of the filler to be blended is determined ad libitum so that the intended specific gravity of the mid layer 3 can be accomplished. Preferable fillers are magnesium oxide and zinc oxide because it serves not only as an agent for adjusting specific gravity but also as a crosslinking activator.

Various additives such as anti-aging agents, coloring agents, plasticizers, dispersant and the like may be blended at an appropriate amount to the matrix 6 as needed.

The solid particle 7 can be usually obtained by crosslinking of a rubber composition. For the solid particle 7, similar base rubbers to those used in the matrix 6 as described above can be used. Furthermore, similar crosslinking agents, organic peroxides, fillers and other additives to those which may be blended in the matrix 6 as described above can be blended.

The amount of the co-crosslinking agent to be blended is preferably 5 parts or greater and 60 parts or less per 100 parts of the base rubber. When the amount to be blended is less than the above range, hardness of the solid particle 7 becomes so low that the flight performance of the golf ball 1 may become insufficient. In this respect, the amount to be blended is more preferably 10 parts or greater, and particularly preferably 15 parts or greater. When the amount to be blended is beyond the above range, the solid particle 7 may be so hard that poor feel at impact of the golf ball 1 may be experienced despite that hardness of the matrix 6 is rendered to be low. In this respect, the amount to be blended is more preferably 55 parts or less, even more preferably 50 parts or less, and particularly preferably 40 parts or less. The amount of the organic peroxide to be blended in the solid particle 7 is determined to be comparable to the amount for the matrix 6.

The solid particles 7 may be obtained through crosslinking of a rubber composition in a mold having a cavity of which size being predetermined. Alternatively, the solid particles 7 may be obtained through grinding of a rubber block post crosslinking. In either case, crosslinking temperature is set to be from 130° C. to 180° C., with the crosslinking time period of from 10 minutes to 60 minutes.

The solid particles 7 may also be formed from a resin composition. In general, a thermoplastic resin is used. Illustrative examples of suitable thermoplastic resin include ionomer resins, polyesters, polyurethanes polyolefins and thermoplastic styrene elastomers. Two or more kinds of thermoplastic resins may be used in combination. Additives such as fillers, coloring agents and the like may be blended in the resin composition as needed. The solid particles 7 may be obtained through filling a resin composition into a mold having a cavity of which size being predetermined. Alternatively, the solid particles 7 may be obtained through grinding of a resin block. Also, a resin composition extruded into a linear shape may be cut to yield a pellet shape, which can be used as the solid particle 7.

Examples of the shape of the solid particles 7 include sphere, cube, rectangular solid and circular cylinder. In view of the formability of the mid layer 3, substantially spherical solid particles 7 are suitable. Specific gravity of the solid particles 7 is usually 0.8 or greater and 1.5 or less.

The mid layer 3 of which matrix 6 is composed of a crosslinked rubber is obtained by a compression molding method in which half shells are used. In this method, a half shell is formed from a rubber composition for the matrix having solid particles 7 dispersed therein, and a core 2 (This core 2 may be either crosslinked or uncrosslinked.) is covered by two half shells. Then, this core 2 and half shells are compressed and heated in a mold. By heating, a crosslinking reaction of the rubber takes place. The crosslinking temperature is set to be from 140° C. to 170° C., with the crosslinking time period of from 10 minutes to 40 minutes. The core 2 and the mid layer 3 may be formed by covering a plug composed of a rubber composition for the core with semicrosslinked half shells, followed by compression and heating. Half shells comprising no solid particle 7 are formed, and then solid particles 7 may be embedded into these half shells. The mid layer 3 of which matrix 6 is composed of a resin composition is also obtained by a compression molding method in which half shells are used, an injection molding method or the like.

The core 2 is usually composed of a crosslinked rubber. For the core 2, similar base rubbers to those for the matrix 6 described above can be used. In addition, similar co-crosslinking agents and organic peroxides to those for use in the matrix 6 as described above can be blended. It is preferred that the amount of the co-crosslinking agent to be blended be 10 parts or greater and 50 parts or less per 100parts of the base rubber. When the amount to be blended is less than the above range, the resilience performance of the golf ball 1 may become insufficient despite that solid particles 7 having high hardness are blended. In this respect, the amount to be blended is more preferably 12 parts or greater, and particularly preferably 15 parts or greater. When the amount to be blended is beyond the above range, the feel at impact of the golf ball 1 may be hard despite that hardness of the matrix 6 is rendered to be low. In this respect, the amount to be blended is particularly preferably 45 parts or less.

The amount of the organic peroxide to be blended in the core 2 is preferably 0.1 part or greater and 3.0 parts or less per 100 parts of the base rubber. When the amount to be blended is less than the above range, the resilience performance of the golf ball 1 may become insufficient despite that solid particles 7 having high hardness are blended. In this respect, the amount to be blended is more preferably 0.2 part or greater, even more preferably 0.4 part or greater and particularly preferably 0.5 parts or greater. When the amount to be blended is beyond the above range, hard feel at impact of the golf ball 1 may be experienced despite that hardness of the matrix 6 is rendered to be low. In this respect, the amount to be blended is particularly preferably 2.5 parts or less.

The core 2 may be blended with a filler for the purpose of e.g., adjusting specific gravity. Examples of the suitable filler include inorganic salts such as zinc oxide, barium sulfate, calcium carbonate and the like; and powder of highly dense metal such as tungsten, molybdenum and the like. The amount of the filler to be blended is determined ad libitum so that the intended specific gravity of the core 2 can be accomplished. Preferable filler is zinc oxide because it serves not only as an agent for adjusting specific gravity but also as a crosslinking activator. Various additives such as sulfur, anti-aging agents, coloring agents, plasticizers, dispersant and the like may be blended at an appropriate amount to the core 2 as needed. To the core 2, may also be blended powder of a crosslinked rubber or powder of a synthetic resin.

The core 2 can be obtained through placing a rubber composition into a cavity of a mold, followed by compression and heating. By heating, a crosslinking reaction of the rubber takes place. The crosslinking temperature is set to be from 140° C. to 180° C., with the crosslinking time period of from 10 minutes to 60 minutes. The diameter of the core 2 is generally 25 mm or greater and 41 mm or less, and particularly 27 mm or greater and 40 mm or less.

In general, the cover 4 is composed of a resin composition. Illustrative examples of particularly preferable base resins include ionomer resins, polyesters, polyurethanes polyolefins and various thermoplastic elastomers, and any mixture thereof may be used.

Of the ionomer resins, copolymers of α-olefin and α,β-unsaturated carboxylic acid having 3 to 8 carbon atoms in which part of the carboxylic acid is neutralized with a metal ion are suitable. As the α-olefin herein, ethylene and propylene are preferred. Acrylic acid and methacrylic acid are preferred as the α,β-unsaturated carboxylic acid. Metal ions for the neutralization include: alkaline metal ions such as sodium ion, potassium ion, lithium ion and the like; bivalent metal ions such as zinc ion, calcium ion, magnesium ion and the like; trivalent metal ions such as aluminum ion, neodymium ion and the like. The neutralization may also be carried out with two or more kinds of metal ions. In light of the resilience performance and durability of the golf ball 1, particularly suitable metal ions are sodium ion, zinc ion, lithium ion and magnesium ion.

Specific examples of suitable ionomer resin include "Himilan 1555", "Himilan 1557", "Himilan 1601", "Himilan 1605", "Himilan 1652", "Himilan 1705", "Himilan 1706", "Himilan 1707", "Himilan 1855", "Himilan 1856", trade names by Mitsui-Dupont Polychemical Co. Ltd.; "Surlyn® 9945", "Surlyn® 8945", "Surlyn® AD8511", "Surlyn® AD8512", trade names by Dupont; and "IOTEK 7010", "IOTEK 8000", trade names by Exxon Corporation. Two or more kinds of ionomer resins may be used in combination.

Preferable thermoplastic elastomers include thermoplastic polyurethane elastomers, thermoplastic polyamide elastomers, thermoplastic polyester elastomers, thermoplastic styrene elastomers, and thermoplastic elastomers having OH groups at their ends. Two or more kinds of thermoplastic elastomers may be used in combination. In light of the resilience performance of the golf ball 1, thermoplastic polyester elastomers and thermoplastic styrene elastomers are particularly suitable.

Thermoplastic styrene elastomers (thermoplastic elastomers containing styrene blocks) include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS).

Illustrative examples of thermoplastic polyurethane elastomers include "Elastolan", trade name by BASF Polyurethane Elastomers Co., Ltd., and more specifically, "Elastolan ET880" can be exemplified. Illustrative examples of thermoplastic polyamide elastomers include "Pebax®", trade name by Toray Industries, Inc., and more specifically, "Pebax® 2533" can be exemplified. Illustrative examples of thermoplastic polyester elastomers include "Hytrel®", trade name by Dupont-Toray Co., Ltd., and more specifically, "Hytrel® 3548" and "Hytrel® 4047" can be exemplified. Illustrative examples of thermoplastic styrene elastomers include "Rabalon®", trade name by Mitsubishi Chemical Corporation, and more specifically, "Rabalon® SR04" can be exemplified.

To a resin composition for use in the cover 4, a diene block copolymer may be blended. A diene block copolymer has a polymer block of which basis being a vinyl aromatic compound, and a polymer block of which basis being a conjugated diene compound. The diene block copolymer has double bonds derived from a conjugated diene compound. A partially hydrogenated diene block copolymer can also be suitably employed.

Exemplary vinyl aromatic compounds that constitute the diene block copolymer include styrene, α-methylstyrene, vinyltoluene, p-t-butylstyrene and 1,1-diphenylstyrene, and one or more compounds are selected from these. Particularly, styrene is suitable. Exemplary conjugated diene compounds include butadiene, isoprene, 1,3-pentadiene and 2,3-dimethyl-1,3-butadiene, and one or more compounds are selected from these. Specifically, butadiene and isoprene, and a combination thereof are suitable.

Preferable diene block copolymer includes: those of which structure being SBS (styrene-butadiene-styrene) having polybutadiene blocks containing epoxy groups, and those of which structure being SIS (styrene-isoprene-styrene) having polyisoprene blocks containing epoxy groups. Illustrative examples of diene block copolymer include "Epofriend®", trade name by Daicel Chemical Industries, Ltd., and more specifically, "Epofriend® A1010" can be exemplified.

Coloring agents such as titanium dioxide, fillers such as barium sulfate, dispersant, anti-aging agents, ultraviolet absorbents, light stabilizers, fluorescent agents, fluorescent brightening agents and the like may be blended at an appropriate amount to the cover 4 as needed. The cover 4 may be blended with powder of highly dense metal such as tungsten, molybdenum and the like for the purpose of adjusting specific gravity.

It is preferred that Shore D hardness of the cover 4 be 40 or greater and 70 or less. When the hardness is less than the above range, spin speed immediately after the impact is not lowered, despite that the solid particles having high hardness are blended, and thus the flight performance of the golf ball 1 may become insufficient. In this respect, the hardness is preferably 42 or greater, and particularly preferably 45 or greater. When the hardness is beyond the above range, poor feel at impact may be experienced despite that hardness of the matrix 6 is rendered to be low. In this respect, the hardness is preferably 68 or less, and particularly preferably 66 or less.

Thickness of the cover 4 is generally 0.5 mm or greater and 2.5 mm or less, and particularly, 1.0 mm or greater and 2.3 mm or less. In order to form the cover 4, known procedure such as an injection molding method, a compression molding method and the like may be employed. By providing a number of protrusions on the cavity face of a mold, dimples 5 having a reversed shape of such a protrusion are formed on the surface of the cover 4. The plane shape of the dimple 5 (i.e., the contour of the dimple 5 observed by viewing the center of the golf ball 1 at infinity) is usually circular, however, a non-circular shape (e.g., ellipsoid, oval, polygon, star, tear drops and the like) is also permitted. Sectional shape of the circular dimple may be a single radius shape (i.e., circular-arc), or a double radius shape (i.e., dish-like) In view of the flight performance, total number of the dimples 5 is preferably from 250 to 540, and particularly preferably from 300 to 450. In view of the flight performance, it is preferred that summation of volume of the dimples be 300 $mm^3$ or greater and 700 $mm^3$ or less and particularly preferably 400 $mm^3$ or greater and 600 $mm^3$ or less. Volume of a dimple means volume of a space surrounded by the surface of a dimple 5 and a phantom spherical surface of the ball. In view of the flight performance, it is preferred that surface area occupation ratio of dimples 5 be 65% or greater and 90% or less, and particularly 70% or greater and 85% or less. The surface area occupation ratio means a percentage of the summation of plain area of the dimples 5 occupied in the surface area of the phantom spherical surface of the ball.

The amount of compressive deformation of the core 2 is preferably 2.0 mm or greater and 7.0 mm or less, and particularly preferably 2.2 mm or greater and 6.5 mm or less. The amount of compressive deformation of a spherical body composed of the core 2 and the mid layer 3 is preferably 2.0 mm or greater and 7.0 mm or less, more preferably 2.2 mm or greater and 6.5 mm or less, and particularly preferably 2.5 mm or greater and 6.0 mm or less. The amount of compressive deformation of the golf ball 1 is preferably 2.0 mm or greater and 5.5 mm or less, and particularly preferably 2.1 mm or greater and 5.2 mm or less. In order to measure the amount of compressive deformation, a subject spherical body is first placed on a hard plate made of metal. Next, a cylinder made of metal gradually descends toward the spherical body, and thus the spherical body, which is intervened between the bottom face of the cylinder and the hard plate, is deformed. Then, a migration distance of the cylinder is measured, starting from the state in which initial load of 98 N is applied to the spherical body up to the state in which final load of 1274 N is applied thereto. This value of migration distance is referred to as an amount of compressive deformation.

The core 2 of the golf ball 1 depicted in FIG. 1 is composed of a single layer, however, a core composed of two or more layers may be employed. The cover 4 of the golf ball 1 depicted in FIG. 1 is composed of a single layer, however, a cover composed of two or more layers may also be employed. Another mid layer may be provided between the core 2 and the mid layer 3, and another mid layer may be provided between the mid layer 3 and the cover 4.

EXAMPLES

[Manufacture of Solid Particle]

[Solid Particle A]

A rubber composition was obtained by kneading 100 parts of polybutadiene (trade name "BR11" available from JSR Corporation), 16 parts of zinc acrylate, 20 parts of zinc oxide and 0.9 part of dicumyl peroxide in an internal kneading machine. This rubber composition was placed in a mold, and kept at 160° C. for 30 minutes to obtain a crosslinked molded piece in a sheet form. Hardness Hg of this crosslinked molded piece was 28. This crosslinked molded piece was grinded in a grinding machine, and then the particles were sorted with a sieve to obtain solid particles A having a particle size D of 0.7 mm.

[Solid Particle D]

In a similar manner to that for the solid particle A except that the zinc acrylate, zinc oxide and dicumyl peroxide were blended at the amounts as shown in Table 1 below, solid particles D were obtained.

[Solid Particle C2]

In a similar manner to that for the solid particle A except that a molded piece was ground which was obtained by extruding a thermoplastic polyester elastomer ("Hytrel® 4047" described above) into a mold, solid particles C2 were obtained.

[Solid Particles C1 and C3]

In a similar manner to that for the solid particle C2 except that the particle size D was changed as shown in Table 1 below, solid particles C1 and C3 were obtained.

[Solid Particles B, E and F]

In a similar manner to that for solid particle C2 except that a thermoplastic polymer shown in Table 1 below was used instead of the thermoplastic polyester elastomer, solid particles B, E and F were obtained.

TABLE 1

| | Constitution of solid particle | | | | | | | |
|---|---|---|---|---|---|---|---|---|
| Type | A | B | C1 | C2 | C3 | D | E | F |
| polybutadiene | 100 | — | — | — | — | 100 | — | — |
| zinc acrylate | 16 | — | — | — | — | 26 | — | — |
| zinc oxide | 20 | — | — | — | — | 10 | — | — |
| dicumyl peroxide | 0.9 | — | — | — | — | 1 | — | — |
| Himilan 1605 | — | 23 | — | — | — | — | 40 | 50 |
| Himilan 1706 | — | 23 | — | — | — | — | 40 | 50 |
| Hytrel ® 4047 | — | — | 100 | 100 | 100 | — | 20 | — |
| Rabalon ® SR04 | — | 54 | — | — | — | — | — | — |
| hardness Hg (shore D) | 28 | 35 | 40 | 40 | 40 | 50 | 60 | 64 |
| particle size D (mm) | 0.7 | 0.7 | 0.2 | 0.7 | 1.5 | 0.7 | 0.7 | 0.7 |

Experiment 1

Example 1

A rubber composition was obtained by kneading 100 parts of polybutadiene ("BR11" described above), 22 parts of zinc acrylate, 10 parts of zinc oxide, 0.9 part of dicumyl peroxide and an appropriate amount of barium sulfate in an internal kneading machine. This rubber composition was placed in a mold having a spherical cavity, and kept at 155° C. for 20 minutes to obtain a core having a diameter of 36.5 mm. To make the weight of the golf ball 45.4 g, the amount of barium sulfate blended was adjusted.

Next, a rubber composition was obtained by kneading 100 parts of polybutadiene ("BR11" described above), 15 parts of zinc acrylate, 20 parts of zinc oxide and 0.8 part of dicumyl peroxide in an internal kneading machine, and by further kneading after placing 20 parts (13% by weight) of the solid particle C2 (hardness: 40, particle size D: 0.7 mm). This rubber composition was placed into a mold and compressed to give a half shell. The core was covered by two of the half shells. The core and the half shells were placed into a mold followed by keeping at 160° C. for 19 minutes to form a mid layer comprising a matrix and solid particles. Thickness T of the mid layer was 1.5 mm; diameter of a spherical body composed of the core and the mid layer was 39.5 mm; hardness Hm of the matrix was 28; difference of hardness (Hg−Hm) was 12; and ratio "D/T" was 0.47.

Next, 45 parts of an ionomer resin ("Himilan 1605" described above), 45 parts of another ionomer resin ("Himilan 1706" described above), and 10 parts of additional another ionomer resin ("Himilan 1555" described above) and 2 parts of barium sulfate were kneaded to give a resin composition. On the other hand, the core was placed into a mold having a spherical cavity, and thereafter the resin composition that had been melted by heating was injected around the core to form a cover having thickness of 1.6 mm. Hardness (Shore D) of this cover was 62. Paint was applied around this cover, and thus a golf ball of Example 1 was obtained.

Examples 3 and 4

In a similar manner to Example 1 except that the amount of the solid particles C2 blended was as shown in Table 2 below, golf balls of Examples 3 and 4 were obtained.

Example 5 and Comparative Example 2

In a similar manner to Example 1 except that solid particles (C1, C3) having altered particle size D were used, golf balls of Example 5 and Comparative Example 2 were obtained.

Examples 2, 6 and 7, and Comparative Example 1

In a similar manner to Example 1 except that solid particles (A, B, D, E) having altered hardness Hg were used, golf balls of Examples 2, 6 and 7, and Comparative Example 1 were obtained.

Comparative Example 3

In a similar manner to Example 1 except that no solid particle was blended, a golf ball of Comparative Example 3 was obtained.

[Travel Distance Test]

A driver with a metal head was equipped with a swing machine (True Temper Co.). Then the machine was conditioned to give head speed of 40 m/s, and golf balls were hit therewith. Thereafter, a ratio "Sb/Sh", i.e., a ratio of golf ball speed immediately after the impact (Sb) to head speed just prior to the impact (Sh); launch angle; rotation speed of back spin; and travel distance (i.e., the distance from the launching point to the point where the ball stopped) were measured. Mean values of data which resulted from 10 times measurement are shown in Table 2 below.

[Evaluation of Feel at Impact]

Using a driver with a metal head, golf balls were hit by 10 senior golfers. Thus, the feel at impact was evaluated. Those which were evaluated as satisfactory in the feel at impact by 8 or more golfers among the ten golfers were assigned "A", those which were evaluated as satisfactory by from 6 to 7 golfers were assigned "B", those which were evaluated as satisfactory by from 4 to 5 golfers were assigned "C", and those which were evaluated as satisfactory by 3 or less golfers were assigned "D". The results are presented in Table 2 below.

TABLE 2

Results of Experiment 1

| | | Com. Example 1 | Example 2 | Com. Example 2 | Example 3 | Example 1 | Example 4 | Example 5 | Example 6 | Example 7 | Com. Example 3 |
|---|---|---|---|---|---|---|---|---|---|---|---|
| solid particle | Type | A | B | C1 | C2 | C2 | C2 | C3 | D | E | — |
| | hardness Hg (shore D) | 28 | 35 | 40 | 40 | 40 | 40 | 40 | 50 | 60 | — |
| | particle size D (mm) | 0.7 | 0.7 | 0.2 | 0.7 | 0.7 | 0.7 | 1.5 | 0.7 | 0.7 | — |
| | blended amount (parts) | 20 | 20 | 20 | 7 | 20 | 90 | 20 | 20 | 20 | — |
| | blended amount (% by weight) | 13 | 13 | 13 | 5 | 13 | 40 | 13 | 13 | 13 | — |
| matrix hardness Hm (shore D) | | 28 | 28 | 28 | 28 | 28 | 28 | 28 | 28 | 28 | 28 |
| difference of hardness (Hg − Hm) | | 0 | 7 | 12 | 12 | 12 | 12 | 12 | 22 | 32 | — |
| Ratio (D/T) | | 0.47 | 0.47 | 0.13 | 0.47 | 0.47 | 0.47 | 1.00 | 0.47 | 0.47 | — |
| Sb/Sh | | 1.442 | 1.444 | 1.442 | 1.444 | 1.444 | 1.445 | 1.445 | 1.445 | 1.446 | 1.442 |
| launch angle (degree) | | 12.0 | 12.4 | 12.2 | 12.4 | 12.4 | 12.7 | 12.5 | 12.6 | 12.6 | 12.0 |
| spin speed (rpm) | | 2850 | 2650 | 2750 | 2650 | 2600 | 2450 | 2500 | 2500 | 2500 | 2800 |
| travel distance (m) | | 207 | 209 | 207 | 209 | 209 | 211 | 210 | 210 | 211 | 207 |
| feel at impact | | D | B | C | B | A | A | A | A | A | D |

From the comparison of Examples 1, 3 and 4, and Comparative Example 3, it is found that preferable range of the proportion of the solid particles occupied in the mid layer is 5% by weight or greater. From the comparison of Examples 1 and 5, and Comparative Example 2, it is found that necessary particle size D of the solid particles is 0.5 mm or greater. From the comparison of Examples 1, 2, 6 and 7, and Comparative Example 1, it is found that necessary difference of hardness (Hg−Hm) is greater than 5. Accordingly, advantages of the present invention are clearly indicated by these results of evaluation.

Experiment 2

Example 8

A rubber composition was obtained by kneading 100 parts of polybutadiene ("BR11" described above), 19 parts of zinc acrylate, 10 parts of zinc oxide, 0.9 part of dicumyl peroxide and an appropriate amount of barium sulfate in an internal kneading machine. This rubber composition was placed in a mold having a spherical cavity, and kept at 160° C. for 22 minutes to obtain a core having a diameter of 31.9 mm. To make the weight of the golf ball 45.4 g, the amount of barium sulfate blended was adjusted.

Next, a rubber composition was obtained by kneading 100 parts of polybutadiene ("BR11" described above), 30 parts of zinc acrylate, 20 parts of zinc oxide and 0.8 part of dicumyl peroxide in an internal kneading machine, and by further kneading after placing 20 parts (12% by weight) of the solid particles E (hardness: 60, particle size D: 0.7 mm). This rubber composition was placed into a mold and compressed to give a half shell. The core was covered by two of the half shells. The core and the half shells were placed into a mold followed by keeping at 160° C. for 19 minutes to form a mid layer comprising a matrix and solid particles. Thickness T of the mid layer was 3.8 mm; diameter of a spherical body composed of the core and the mid layer was 39.5 mm; hardness Hm of the matrix was 54; difference of hardness (Hg−Hm) was 6; and ratio "D/T" was 0.18. Next, a cover was formed and paint was applied around this cover similarly to Example 1 to obtain a golf ball of Example 8.

Examples 9 and 10

In a similar manner to Example 8 except that the amount of the solid particles E blended was as shown in Table 3 below, golf balls of Examples 9 and 10 were obtained.

Example 11 and Comparative Example 4

In a similar manner to Example 8 except that solid particles (D, F) having altered hardness Hg were used, golf balls of Example 11 and Comparative Example 4 were obtained.

Comparative Example 5

In a similar manner to Example 8 except that no solid particle was blended, a golf ball of Comparative Example 5 was obtained.

[Evaluation]

Similarly to Experiment 1, travel distance test and evaluation of the feel at impact were performed. The results are shown in Table 3 below.

TABLE 3

Results of Experiment 2

| | | Com. Example 4 | Example 9 | Example 8 | Example 10 | Example 11 | Com. Example 5 |
|---|---|---|---|---|---|---|---|
| solid particle | Type | D | E | E | E | F | — |
| | hardness Hg (shore D) | 50 | 60 | 60 | 60 | 64 | — |
| | particle size D (mm) | 0.7 | 0.7 | 0.7 | 0.7 | 0.7 | — |
| | blended amount (parts) | 20 | 8 | 20 | 100 | 20 | — |
| | blended amount (% by weight) | 12 | 5 | 12 | 40 | 12 | — |
| matrix hardness Hm (shore D) | | 54 | 54 | 54 | 54 | 54 | 54 |
| difference of hardness (Hg − Hm) | | −4 | 6 | 6 | 6 | 10 | — |
| ratio (D/T) | | 0.18 | 0.18 | 0.18 | 0.18 | 0.18 | — |
| Sb/Sh | | 1.444 | 1.445 | 1.445 | 1.446 | 1.445 | 1.444 |
| launch angle (degree) | | 11.7 | 12.0 | 12.1 | 12.2 | 12.2 | 11.8 |
| spin speed (rpm) | | 2750 | 2600 | 2650 | 2500 | 2600 | 2700 |
| travel distance (m) | | 208 | 211 | 212 | 214 | 214 | 210 |
| feel at impact | | D | B | A | A | A | D |

From the comparison of Examples 8, 9 and 10, and Comparative Example 5, it is found that preferable range of the proportion of the solid particles occupied in the mid layer is 5% by weight or greater. From the comparison of Examples 8 and 11, and Comparative Example 4, it is found that necessary difference of hardness (Hg−Hm) is greater than 5. Accordingly, advantages of the present invention are clearly indicated by these results of evaluation.

The description herein above is merely for illustrative examples, and therefore, various modifications can be made without departing from the principles of the present invention.

What is claimed is:

1. A golf ball having a core, a mid layer and a cover, wherein said mid layer comprises (1) a matrix of which base material is a rubber or a synthetic resin, and (2) solid particles which are dispersed in said matrix and have a particle size D of equal to or greater than 0.5 mm, the weight percentage of the solid particles in the mid-layer is from 5% by weight or greater to 50% by weight or less of the total weight of the solid particles in the mid-layer and the matrix in the mid-layer, when it is assumed that Shore D hardness of said solid particles be Hg and Shore D hardness of said matrix be Hm, a value (Hg−Hm) is greater than 5, and said particles are absent from said core.

2. The golf ball according to claim 1 wherein Shore D hardness Hg of said solid particles is equal to or greater than 40.

3. The golf ball according to claim 2 wherein Shore D hardness Hm of said matrix is equal to or greater than 30.

4. The golf ball according to claim 1 wherein Shore D hardness Hm of said matrix is equal to or greater than 30.

5. The golf ball according to claim 1 wherein a ratio D/T of the particle size D of said solid particles to the thickness T of the mid layer is equal to or greater than 0.1 and equal to or less than 0.9.

6. A golf ball having a core, a mid layer and a cover, wherein said mid layer comprises a (1) matrix of which base material is a rubber or a synthetic resin, and (2) solid particles which are dispersed in said matrix and have a particle size D of equal to or greater than 0.5 mm, the weight percentage of the solid particles in the mid-layer is from 5% by weight or greater to 50% by weight or less of the total weight of the solid particles in the mid-layer and the matrix in the mid-layer, when it is assumed that Shore D hardness of said solid particles be Hg and Shore D hardness of said matrix be Hm, a value (Hg−Hm) is greater than 5, and wherein a ratio D/T of the particle size D of said solid particles to the thickness T of the mid layer is equal to or greater than 0.1.

7. The golf ball according to claim 6, wherein the ratio D/T is equal to or greater than 0.2.

8. The golf ball according to claim 6, wherein the ratio D/T is equal to or greater than 0.3.

9. The golf ball according to claim 6 wherein Shore D hardness Hg of said solid particles is equal to or greater than 40.

10. The golf ball according to claim 6 wherein Shore D hardness Hm of said matrix is equal to or greater than 30.

11. The golf ball according to claim 6 wherein a ratio D/T of the particle size D of said solid particles to the thickness T of the mid layer is equal to or greater than 0.1 and equal to or less than 0.9.

12. A golf ball having a core, a mid layer and a cover, wherein said mid layer comprises (1) a matrix of which base material is a rubber or a synthetic resin, and (2) solid particles which are dispersed in said matrix and have a particle size D of equal to or greater than 0.5 mm, the weight percentage of the solid particles in the mid-layer is from 5% by weight or greater to 50% by weight or less of the total weight of the solid particles in the mid-layer and the matrix in the mid-layer, when it is assumed that Shore D hardness of said solid particles be Hg and Shore D hardness of said matrix be Hm, a value (Hg−Hm) is greater than 5, and said particles are absent from said core, and said core has an amount of compressive deformation of between 3.0 mm and 8.0 mm.

13. The golf ball according to claim 12 wherein a ratio D/T of the particle size D of said solid particles to the thickness T of the mid layer is equal to or greater than 0.1 and equal to or less than 0.9.

* * * * *